US008651577B2

(12) United States Patent
Baumann

(10) Patent No.: US 8,651,577 B2
(45) Date of Patent: Feb. 18, 2014

(54) ADJUSTMENT DEVICE

(75) Inventor: Ralph Baumann, Hameln (DE)

(73) Assignee: Wilkhan Wilkening & Hahne GmbH & Co. KG, Bad Munder (DE)

( * ) Notice: Subject to any disclaimer, the term of this patent is extended or adjusted under 35 U.S.C. 154(b) by 349 days.

(21) Appl. No.: 13/120,780

(22) PCT Filed: Feb. 23, 2010

(86) PCT No.: PCT/EP2010/052280
§ 371 (c)(1),
(2), (4) Date: Mar. 24, 2011

(87) PCT Pub. No.: WO2010/108742
PCT Pub. Date: Sep. 30, 2010

(65) Prior Publication Data

US 2011/0175415 A1 Jul. 21, 2011

(30) Foreign Application Priority Data

Mar. 25, 2009 (DE) ..... 10 2009 014 777

(51) Int. Cl.
*A47C 7/40* (2006.01)

(52) U.S. Cl.
USPC ..... 297/353; 297/411.36

(58) Field of Classification Search
USPC ..... 297/353, 410, 411.36
See application file for complete search history.

(56) References Cited

U.S. PATENT DOCUMENTS

| | | | | |
|---|---|---|---|---|
| 4,639,039 | A * | 1/1987 | Donovan | 297/353 |
| 4,660,885 | A | 4/1987 | Suhr | |
| 5,649,741 | A | 7/1997 | Beggs | |
| 5,678,893 | A | 10/1997 | Bock | |
| 5,685,609 | A | 11/1997 | Miotto | |
| 5,695,249 | A * | 12/1997 | Lotfi | 297/353 |
| 5,725,278 | A * | 3/1998 | Verbeek | 297/353 |
| 6,299,253 | B1 | 10/2001 | Chen | |
| 6,709,059 | B1 * | 3/2004 | Cvek | 297/353 |
| 6,840,582 | B2 * | 1/2005 | Burwell et al. | 297/411.36 |
| 7,275,790 | B2 * | 10/2007 | Chi | 297/353 |
| 7,360,837 | B1 * | 4/2008 | Liu | 297/353 |
| 2002/0063460 | A1 * | 5/2002 | Roslund et al. | 297/353 |
| 2003/0057756 | A1 * | 3/2003 | Lai | 297/353 |

FOREIGN PATENT DOCUMENTS

| | | |
|---|---|---|
| AU | 2001100358 A4 | 10/2001 |
| DE | 8205577 | 7/1982 |

* cited by examiner

*Primary Examiner* — Peter Brown

(74) *Attorney, Agent, or Firm* — Renner Kenner Greive Bobak Taylor & Weber

(57) ABSTRACT

The adjustment device according to the invention for an adjustable element, in particular the backrest of a chair, has a guide rail and a sliding element which is movable in the guide rail along an adjustment axis. Furthermore, a blocking element is provided, which blocking element can be secured on the guide rail or on the sliding element in a latching position in which the sliding element can be moved along the adjustment axis at least in one direction between two end positions, wherein the blocking element comes into operative contact with latches spaced apart along the adjustment axis. During the installation of the adjustment device, the blocking element is secured on the guide rail or the sliding element in an installation position in which the sliding element can be introduced into the guide rail in the direction of the adjustment axis.

13 Claims, 6 Drawing Sheets

ADJUSTMENT DEVICE

Figure 1:
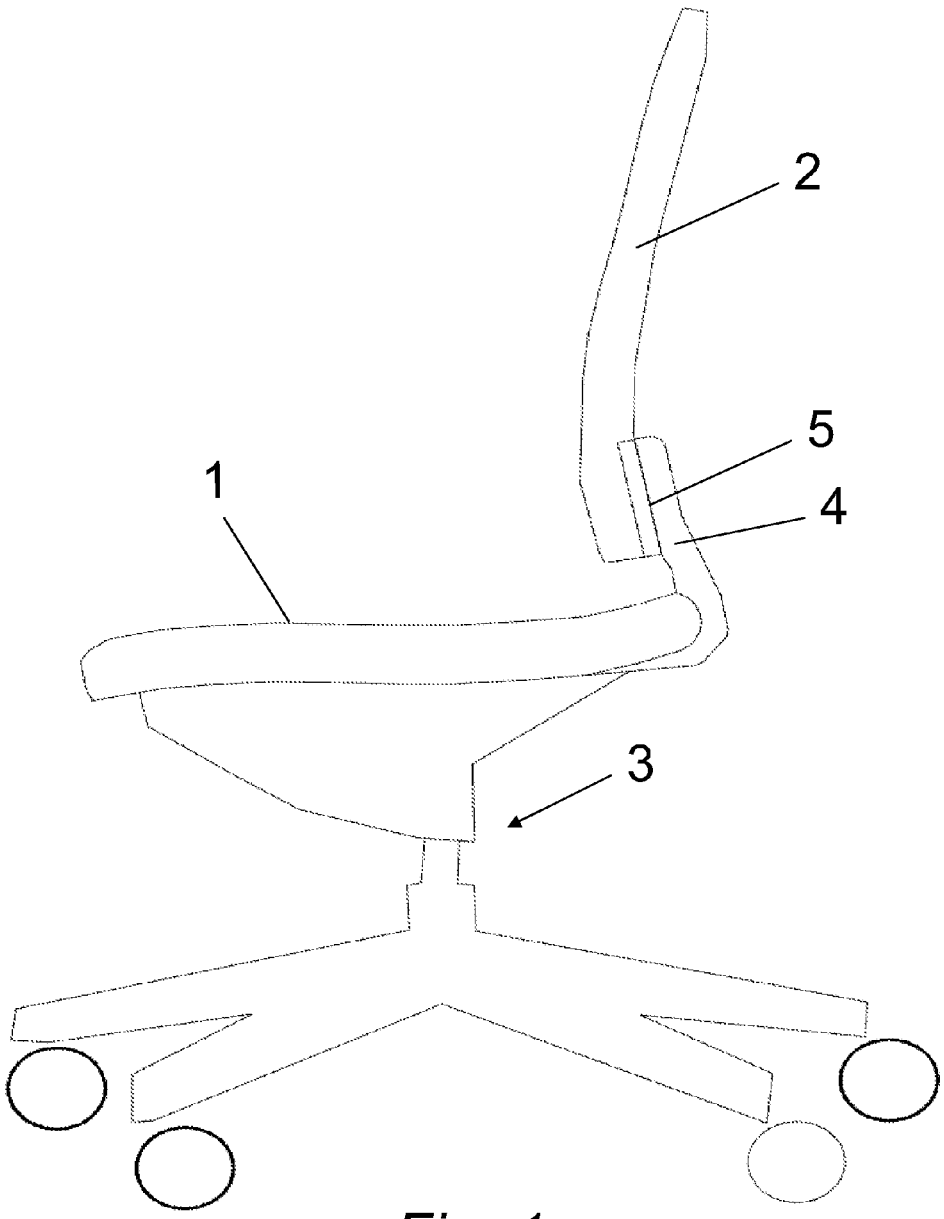

The invention relates to an adjustment device for an adjustable element having a guide rail and a sliding element which can be moved along an adjustment axis in the guide rail and a locking element which is retained on the guide rail or on the sliding element in at least one position for use, in which it limits the movability of the sliding element along the adjustment axis.

Such adjustment devices are used, for example, in chairs in order to adjust the spacing of the backrest relative to the seating surface.

According to DE-U1-295 08 082, there is provided between the backrest carrier and the backrest shell a manually actuatable locking mechanism which is actuated by means of an additional sliding actuation member.

In U.S. Pat. No. 5,685,609, the adjustment device is formed by a pivotably supported locking lever which comes into contact with a locking rail. The locking lever is pressed into the locking rail by means of a resilient element, a relative movement between the locking lever and locking rail only being possible in one direction, whilst the other direction is blocked. At the end of the adjustment path, the locking lever is retained by the resilient element in a non-locking position so that a relative movement of the locking lever relative to the locking rail is possible in the opposite direction. At the other end of the adjustment path, the resilient element releases the locking lever again and presses it against the locking rail. The adjustment device is coupled to the backrest so that it can be adjusted along the adjustment path in terms of height relative to the seating surface. The backrest is screwed to the adjustment device so as to be movable in a sliding manner. The assembly of the backrest on the retaining arm is therefore only possible using a tool.

An object of the invention is therefore to construct the adjustment device in such a manner that the assembly is simplified.

This object is achieved according to the invention by the features of claim 1.

The adjustment device according to the invention for an adjustable element, in particular the backrest of a chair, has a guide rail and a sliding element which can be moved along an adjustment axis in the guide rail. There is further provided a locking element which is retained on the guide rail or on the sliding element in at least one position for use, in which it limits the movability of the sliding element along the adjustment axis. The locking element can be retained on the guide rail or on the sliding element in a locking position for use, in which it comes into operational contact with catches which are spaced-apart along the adjustment axis. The locking element and the catches are further constructed in such a manner that the sliding element can be displaced in only one direction along the adjustment axis when the locking element is in the locking position for use, whilst the adjustment of the sliding element in the opposite direction is blocked by the locking element (8) which is in operational contact with a catch. When the adjustment device is assembled, the locking element is retained on the guide rail or on the sliding element in an assembly position, in which the sliding element can be introduced into the guide rail in the direction of the adjustment axis.

The locking element can consequently be retained on the guide rail or on the sliding element not only in a position for use, but also in an assembly position. In this manner, the sliding element can be introduced readily into the guide rail in the direction of the adjustment axis during assembly. With the device according to the invention, it is in particular possible to assemble the adjustment device without an additional tool.

The dependent claims relate to other configurations of the invention.

According to a preferred configuration of the invention, the locking element is retained on the guide rail. Furthermore, the locking element can be constructed in a resilient manner so that it is possible to dispense with an additional resilient element.

The locking element can further be retained on the guide rail or on the sliding element in a non-locking position for use in which the sliding element can be moved in a limited manner along the adjustment axis, the locking element having no operational contact with the catches.

The locking element can then consequently be retained on the guide rail or on the sliding element in a locking position for use, in a non-locking position for use and in an assembly position. The limited movement freedom of the sliding element is ensured, for example, by a mortise and tenon joint between the sliding element and the locking element or by a mortise and tenon joint between the sliding element and the guide rail.

Furthermore, there may be provision for the sliding element, the guide rail and the locking element to co-operate in such a manner that the locking element is moved from the locking position for use to the non-locking position for use when the sliding element is moved to a first end position and the locking element is moved from the non-locking position for use to the locking position for use when the sliding element is moved in an opposite direction to another end position.

The sliding element, the guide rail and the locking element preferably co-operate in such a manner that the sliding element can be introduced into the guide rail in the direction of the adjustment axis when assembling the adjustment device until the locking element is carried by the sliding element and is moved from the assembly position into the at least one position for use. In order to ensure that it is not pulled out, the locking element which is in the at least one position for use allows limited movability of the sliding element along the adjustment axis whilst it prevents the sliding element from being completely withdrawn from the guide rail.

The locking element advantageously has at least one locking projection which comes into operational contact with the catches in the locking position for use. The locking projection can be provided at one end of the locking element, this end being retained so as to be able to be moved in a resilient manner perpendicularly relative to the adjustment direction of the sliding element.

According to a preferred configuration of the invention, the guide rail has for the locking element step-like support faces which define the two positions for use and the assembly position of the locking element. The locking element can further be retained in the guide rail in such a manner that it is pretensioned in its locking position for use and/or in its non-locking position for use and/or in its assembly position.

The adjustment device described above is preferably provided for a chair having a seat and a backrest, the adjustment device described above being used for adjusting the spacing of the backrest relative to the seat.

Figure 2:
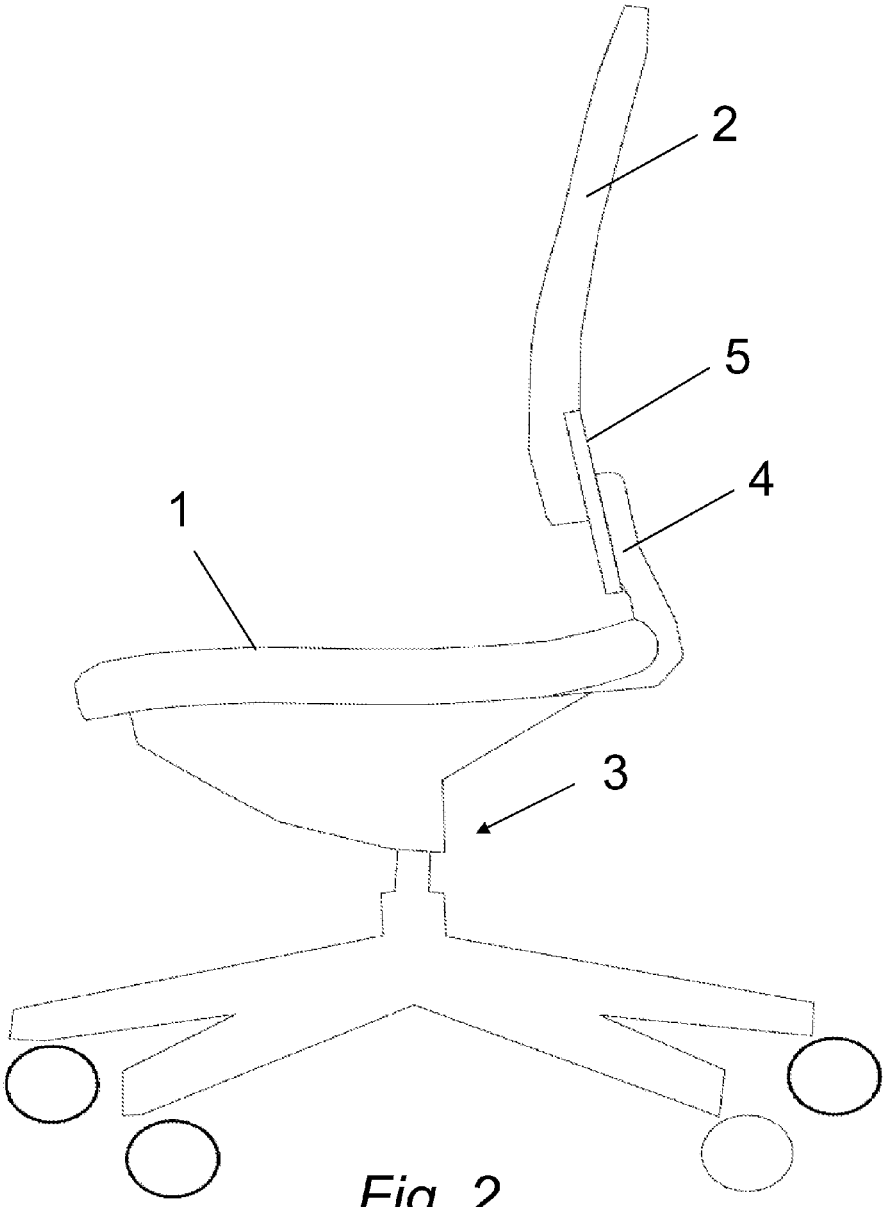
Figure 3:
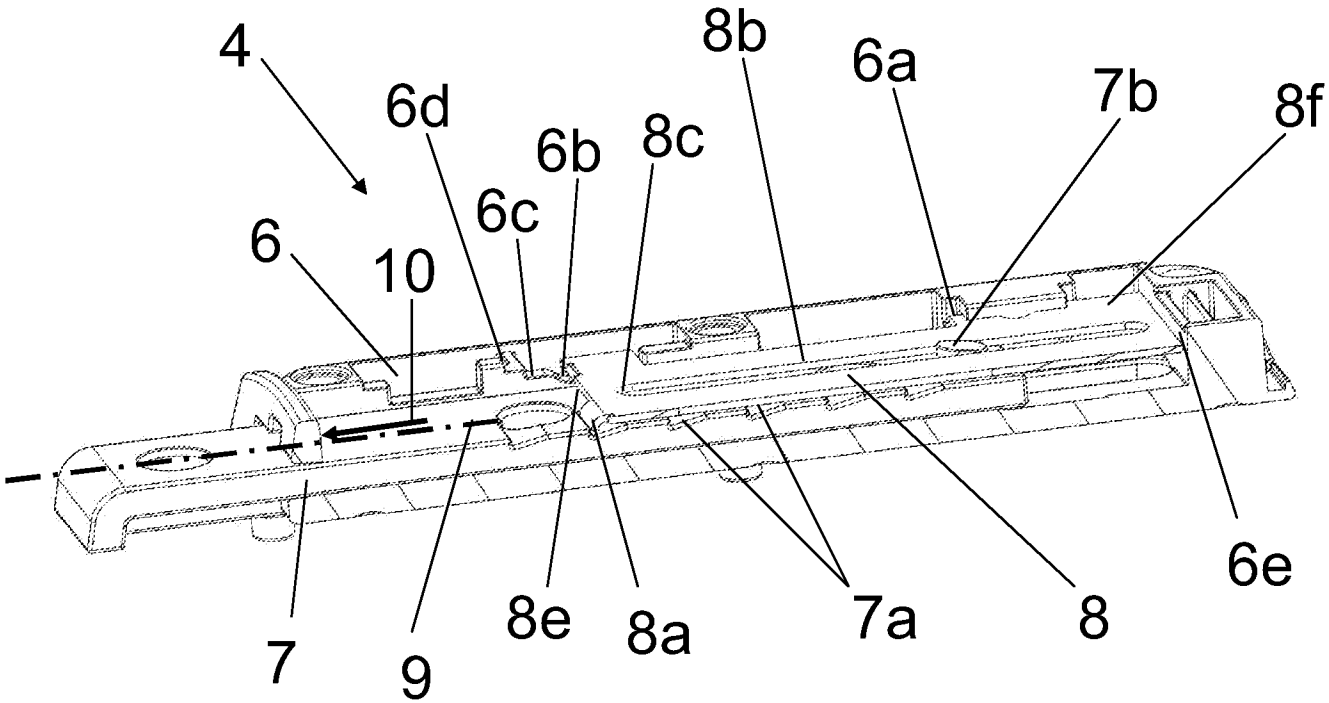
Figure 4:
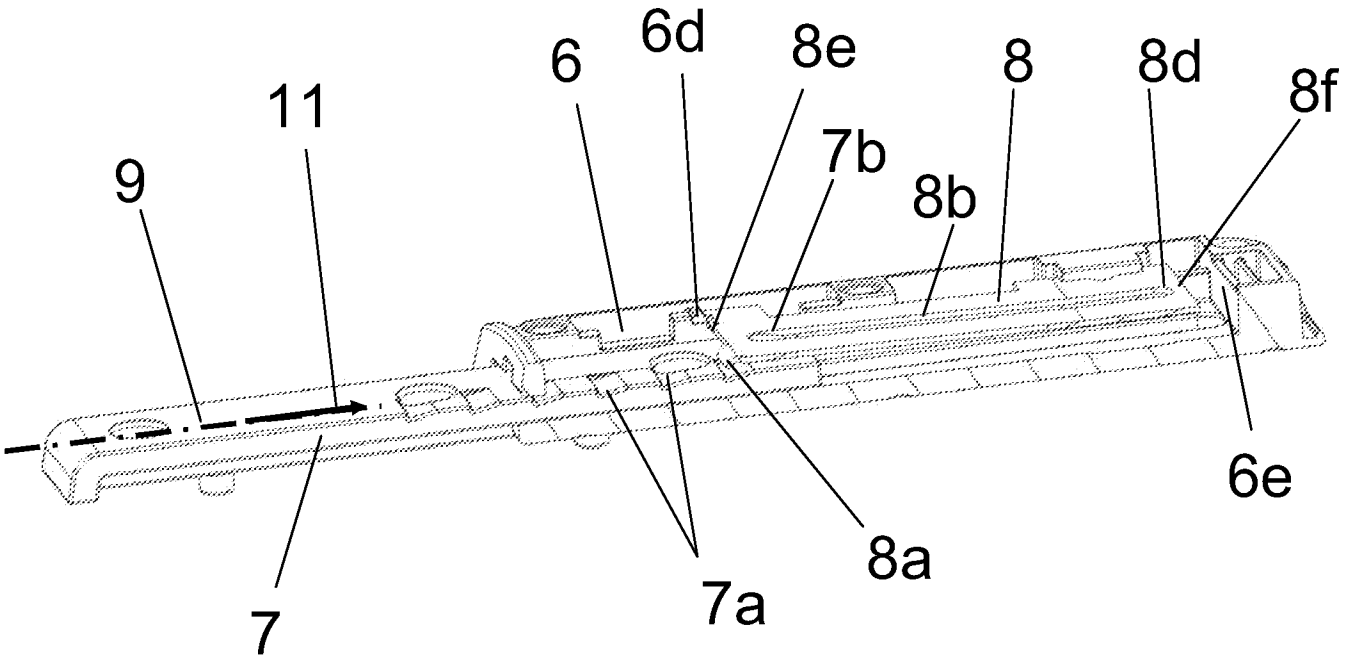
Figure 5:
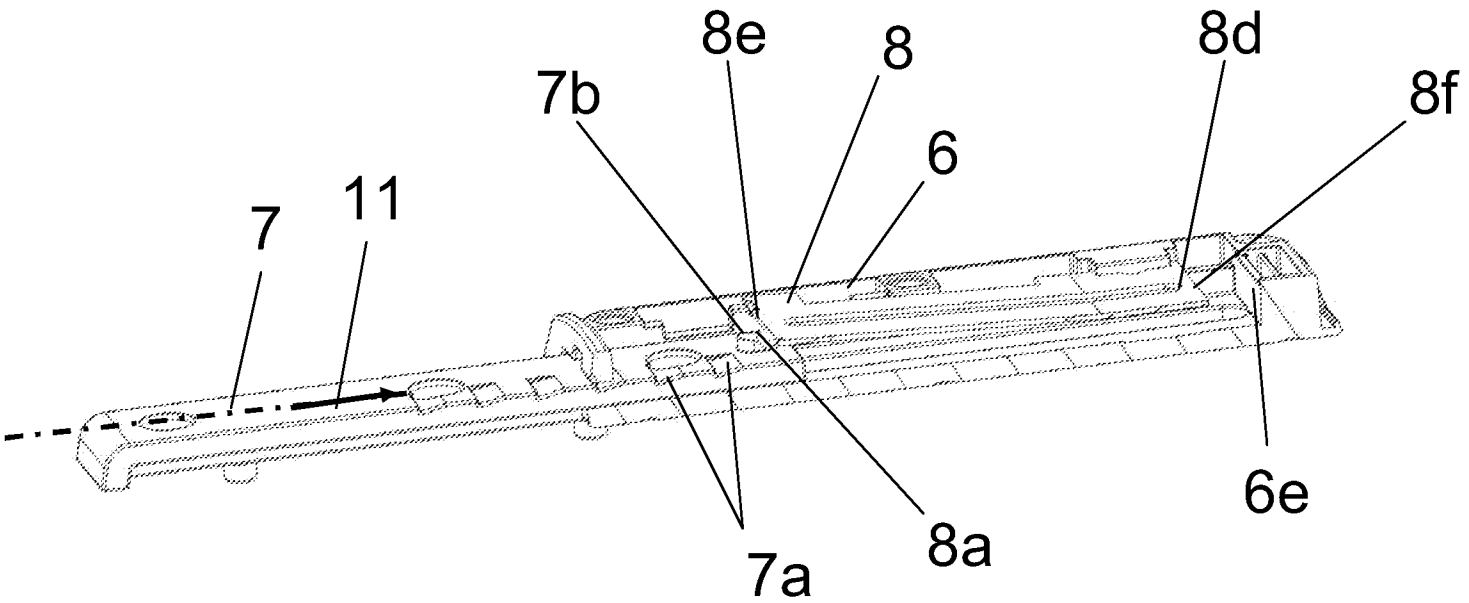
Figure 6:
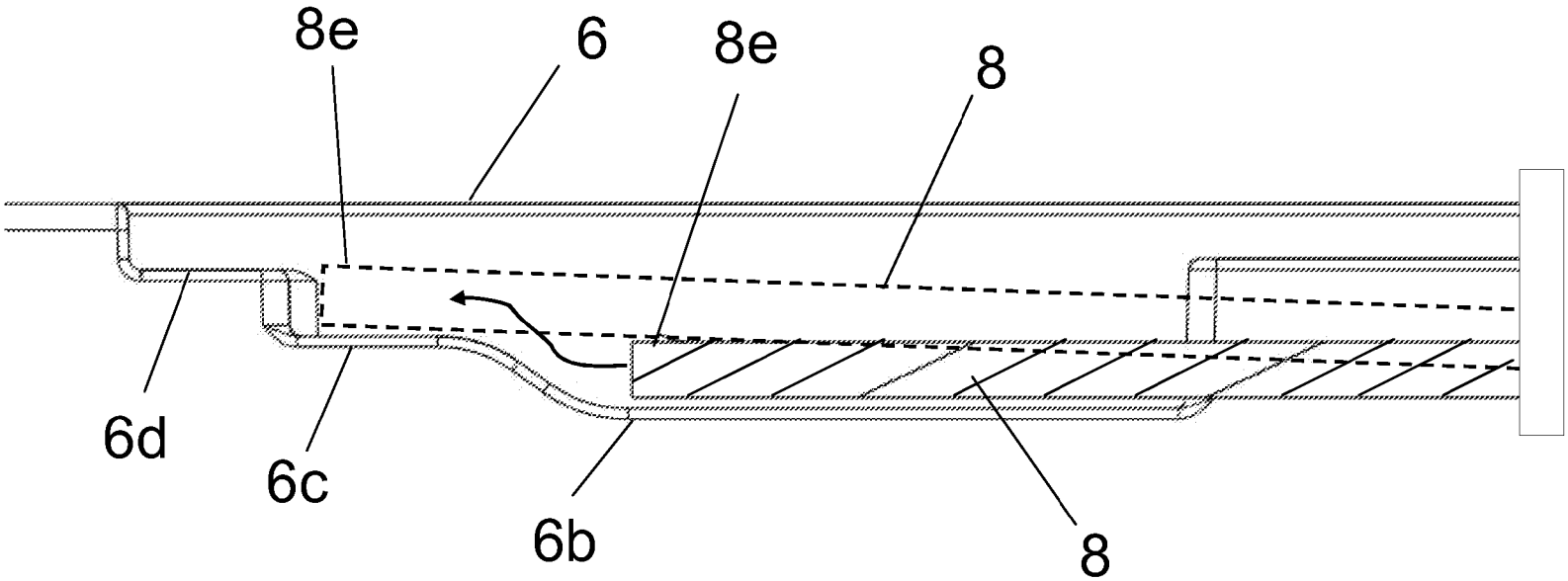

Further advantages and configurations of the invention are explained in greater detail below with reference to the description and the drawings, in which:

FIG. 1 is a schematic illustration of a chair with a backrest in a first position, FIG. 2 is a schematic illustration of a chair with a backrest in a second position, FIG. 3 is a three-dimensional, partially sectioned illustration of the adjustment device with the locking element in the locking position for use, FIG. 4 is a three-dimensional, partially sectioned illustration of the adjustment device with the locking element in the non-locking position for use, FIG. 5 is a three-dimensional, partially sectioned illustration of the adjustment device with the locking element in the assembly position, and FIG. 6 is a schematic illustration of the guide rail and the locking element in the region of the step-like support faces.

The chair illustrated in FIG. 1 has a seat 1, a backrest 2 and an underframe 3. It is, for example, an office chair in this instance.

The backrest 2 is retained on a retaining arm 4 which is secured to the chair by means of an adjustment device 5. The adjustment device 5 allows an adjustment of the spacing of the backrest 2 with respect to the seat. FIGS. 1 and 2 illustrate two different positions of the backrest 2 with respect to the seat.

The adjustment device 4 is explained in greater detail below with reference to FIG. 3 to FIG. 6.

The adjustment device 4 substantially comprises a guide rail 6, a sliding element 7 which can be moved along an adjustment axis 9 in the guide rail and a locking element 8. The locking element 8 is constructed in an elongate, plate-like and resilient manner, having a locking projection 8*a* at one end region 8*e* thereof and being retained at the other end region 8*f* thereof in a groove 6*a* of the guide rail 6 in such a manner that the end region 8*e* can be moved in a resilient manner with the locking projection 8*a* perpendicularly relative to the adjustment axis 9 of the sliding element 7.

On the sliding element 7 there are provided along the adjustment axis 9 a plurality of spaced-apart catches 7*a* which come into operational contact with the locking projection 8*a* of the locking element 8.

In FIG. 3, the locking element 8 is located in the locking position for use thereof. The locking projection 8*a* and the catches 7*a* are constructed in such a manner that the sliding element 7 can only be moved in the direction of the arrow 10 with respect to the guide rail, whilst the adjustment of the sliding element in the opposite direction is blocked by the locking projection 8*a* which is in operational contact with a catch 7*a*.

The locking element 8 further has a longitudinal groove 8*b* which extends in the direction of the adjustment axis 9 and through which a pin 7*b* which is connected to the sliding element 7 extends. When the sliding element 7 is displaced in the direction of the arrow 10, the pin 7*b* consequently moves in the longitudinal groove 8*b* of the locking element 8 until the pin abuts the end 8*c* of the longitudinal groove 8*b*. Further displacement of the sliding element 7 in the direction of the arrow 10 then carries the locking element 8 from the locking position for use according to FIG. 3 into a non-locking position for use according to FIG. 4, in which the locking projection 8*a* is raised so far that it has no operational contact with the catches.

The lifting action of the end region 8*e* of the locking element 8 that has the locking projection 8*a* is enabled by means of step-like support faces 6*b*, 6*c* and 6*d* on the guide rail 6. The end region 8*e* of the locking element 8 that has the locking projection 8*a*, in the locking position for use according to FIG. 3, is supported on the support face 6*b*, as shown in the detailed view according to FIG. 6. If the sliding element 7 is pushed together with the locking element 8 further in the direction of the arrow 10, the locking element 8 moves with the end region 8*e* thereof that has the locking projection 8*a* one step higher on the support face 6*c*. In order to facilitate the displacement, the two support faces 6*b* and 6*c* are connected to each other in a ramp-like manner (see FIG. 6). As soon as the locking element 8 is in the position illustrated with broken lines in FIG. 6, further movement of the sliding element 7 together with the locking element 8 in the direction of the arrow 10 is prevented by the locking element 8 abutting the next higher step which has a support face 6*d*. This is achieved in that the two support faces 6*c* and 6*d* are delimited from each other by means of a step which is constructed perpendicularly thereto and consequently further movement of the locking element and therefore further withdrawal of the sliding element which is connected to the longitudinal groove 8*b* of the locking element by means of the pin 7*b* are reliably prevented.

In the non-locking position for use according to FIG. 4 (see also the illustration with broken lines in FIG. 6), the locking projection 8*a* is raised with respect to the catches 7*a* so far that it can no longer come into operational contact with the catches.

In the non-locking position for use of the locking element 8 shown in FIG. 4, the sliding element 7 can therefore be adjusted only in the direction of the arrow 11. The pin 7*b* which is connected to the sliding element 7 moves in the longitudinal groove 8*b* of the locking element 8 as far as the other end 8*d* of the longitudinal groove. Owing to the raised position of the locking projection 8*a*, there is no operational contact with the catches 7*a*. As soon as the pin 7*b* has reached the end 8*d* of the longitudinal groove 8*b* and the sliding element 7 is pushed a little further in the direction of the arrow 11, the locking element 8 is carried until the end region 8*f* of the locking element strikes a stop 6*e* of the guide rail 6. The end region 8*e* of the locking element 8 that has the locking projection 8*a* again slides on the support face 6*b* so that the locking projection 8*a* can again come into operational contact with the catches 7*a* if the sliding element is adjusted again in the direction of the arrow 10 according to FIG. 3.

In order to allow the displacement of the locking element 8 with respect to the guide rail 6, the locking element is guided in the groove 6*a* at the end region 8*d* thereof opposite the locking projection 8*a*, the friction between the guide rail 6 and the locking element 8 being of such a magnitude that on the one hand displacement of the locking element 8 is still possible but independent displacement is prevented.

In order to facilitate the assembly of the adjustment device 5, the locking element 8 can be moved into an assembly position in which it is supported on the support face 6*d* (see FIGS. 5 and 6). This assembly position differs from the non-locking position for use according to FIG. 4 particularly in that not only does the locking projection 8*a* move out of engagement with the catches 7*a* but also the pin 7*b* in this region no longer extends through the longitudinal groove 8*b*. Since the locking element is retained at the end region 8*f* in the groove 6*a* of the guide rail, the locking element becomes slightly bent if it is located with the end region 8*e* on the support faces 6*c* and 6*d*.

In the assembly position, the locking element 8 is bent at the end region 8*e* thereof to such an extent that it is possible to insert the sliding element 7 into the guide rail in the direction of the arrow 11. The further the sliding element 7 is pushed into the guide rail 6, the more the pin 7*b* extends through the longitudinal groove 8*b* until the pin abuts the end 8*d* of the longitudinal groove 8*b* and further displacement of the sliding element 7 in the direction of the arrow 11 brings about simultaneous displacement of the locking element 8, the end region 8*e* of the locking element 8 having the locking projection 8*a* sliding from the support face 6*d* thereof first onto the support face 6*c* and then onto the support face 6*d*, in which the locking element is again in its locking position for use.

When the adjustment device is assembled, the sliding element 7 can therefore be inserted from a position outside the guide rail 6 in the direction of the adjustment axis 9 into the guide rail 6, no additional tool being required for this assembly. On the other hand, the step-like construction of the guide rail in the region of the support faces 6*b* to 6*d* ensures that the sliding element and a backrest which may optionally be fixed thereto cannot unintentionally be completely withdrawn. Of course, however, there will be provision, in the event of repair, for the locking element to be able to be moved from its locking position for use or from its non-locking position for use into the assembly position. To this end, an additional tool is advantageously required in order to ensure that no unintentional disassembly occurs. The assembly position according to FIG. 5 is consequently also suitable for disassembly.

For use in a chair as shown in FIGS. 1 and 2, the guide rail 6 or the sliding element 7 can optionally be connected to the retaining arm 4 and the other component can be connected to the backrest 2, respectively. Prior to the assembly of the backrest, the sliding element 7 is, for example, connected to the retaining arm 4 and the guide rail 6 to the backrest 2. For the assembly, the guide rail 6 which is secured to the backrest simply has to be inserted into the sliding element 7 which is secured to the retaining arm. At the end of the insertion operation, the locking element 8 moves from its assembly position via its non-locking position for use into the locking position for use. The chair is then immediately ready for use.

The invention claimed is:

1. Adjustment device for an adjustable element having a guide rail and a sliding element movable along an adjustment axis in the guide rail and a locking element retained on the guide rail or on the sliding element in a locking position in which the locking element limits movement of the sliding element along the adjustment axis, the locking element selectively retained on the guide rail or on the sliding element in the locking position in which the locking element comes into operational contact with catches that are spaced-apart along the adjustment axis, wherein, when the locking element is retained on the guide rail, said catches are provided on the sliding element, and, when the locking element is retained on the sliding element, the catches are provided on the guide rail, the locking element and the catches being constructed in such a manner that the sliding element can be displaced in only one direction along the adjustment axis when the locking element is in the locking position, whilst the adjustment of the sliding element in an opposite direction is blocked by operational contact between the locking element and one of said catches, the locking element further selectively retained on the guide rail or the sliding element in a non-locking position in which the sliding element can be moved in a limited manner along the adjustment axis, the locking element having no operational contact with the catches in said non-locking position, and, the locking element further selectively retained on the guide rail or on the sliding element in an assembly position in which the sliding element can be selectively removed from or introduced into the guide rail for assembly or disassembly and step-like support faces defining the locking and non-locking positions and the assembly position of the locking element, wherein, when the locking element is retained on the guide rail, the step-like faces are provided on the guide rail, and, when the locking element is retained on the sliding element, the step-like support faces are provided on the sliding element.

2. Adjustment device according to claim 1, characterised in that the locking element is retained on the guide rail.

3. Adjustment device according to claim 1, characterised in that the locking element is constructed in a resilient manner.

4. Adjustment device according to claim 1, characterised in that the limited movement freedom of the sliding element is formed by a mortise and tenon joint between the sliding element and the locking element.

5. Adjustment device according to claim 1, characterised in that the sliding element, the guide rail and the locking element co-operate in such a manner that the locking element is moved from the locking position to the non-locking position when the sliding element is moved to a first end position and the locking element is moved from the non-locking position to the locking position when the sliding element is moved in an opposite direction to another end position.

6. Adjustment device according to claim 1, characterised in that the locking element has at least one locking projection which comes into operational contact with the catches in the locking position.

7. Adjustment device according to claim 1, characterised in that the locking element provides a locking projection at one end thereof, the locking element being resilient such that the locking projection moves in a resilient manner perpendicularly relative to the adjustment axis of the sliding element to engage the catches.

8. Adjustment device according to claim 1, characterised in that the locking element can be displaced between the locking and non-locking positions in an adjustment direction.

9. Adjustment device according to claim 1, characterised in that the locking element is retained in the guide rail in such a manner that it is pretensioned in its locking position for use and/or in its non-locking position for use and/or in its assembly position.

10. Adjustment device according to claim 1, characterised in that, in the assembly position, the sliding element, the guide rail and the locking element co-operate in such a manner that the sliding element can be introduced into the guide rail in the direction of the adjustment axis until the locking element contacts the sliding element and moves it from the assembly position into either the locking or non-locking position.

11. Adjustment device according to claim 10, characterised in that, in the locking and non-locking positions, the sliding element, the guide rail and the locking element co-operate in such a manner that the locking element allows limited movability of the sliding element along the adjustment axis but prevents the sliding element from being completely withdrawn from the guide rail.

12. Chair having a seat, a backrest, and an adjustment device provided in order to adjust the spacing of the backrest relative to the seat, the adjustment device comprising:

a guide rail and a sliding element movable along an adjustment axis in the guide rail and a locking element retained on the guide rail or on the sliding element in a locking position, in which the locking element limits movement of the sliding element along the adjustment axis, the locking element selectively retained on the guide rail or on the sliding element in a locking position in which the locking element comes into operational contact with catches that are spaced-apart along the adjustment axis, wherein, when the locking element is retained on the guide rail, said catches are provided on the sliding element, and, when the locking element is retained on the sliding element, the catches are provided on the guide rail, the locking element and the catches being constructed in such a manner that the sliding element can be displaced in only one direction along the adjustment axis when the locking element is in the locking position, whilst the adjustment of the sliding element in an opposite direction is blocked by operational contact between the locking element and one of said catches, the locking element further selectively retained on the guide rail or the sliding element in a non-locking position in which the sliding element can be moved in a limited manner along the adjustment axis, the locking element having no operational contact with the catches in said non-locking position, and, the locking element further selectively retained on the guide rail or on the sliding element in an assembly position in which the sliding element can be selectively removed from or introduced into the guide rail for assembly or dissassembly and step-like support faces defining the locking and non-locking positions and the assembly position of the locking element, wherein, when the locking element is retained on the guide rail, the step-like faces are provided on the guide rail, and, when the locking element is retained on the sliding element, the step-like support faces are provided on the sliding element.

13. Adjustment device for an adjustable element having a guide rail and a sliding element movable along an adjustment axis in the guide rail and a locking element retained on the guide rail in a locking position in which the locking element limits movement of the sliding element along the adjustment axis, the locking element selectively retained on the guide rail in the locking position in which the locking element comes into operational contact with catches in the sliding element that are spaced-apart along the adjustment axis, the locking element and the catches being constructed in such a manner that the sliding element can be displaced in only one direction along the adjustment axis when the locking element is in the locking position, whilst the adjustment of the sliding element in an opposite direction is blocked by operational contact between the locking element and one of said catches, the locking element further selectively retained on the guide rail in a non-locking position in which the sliding element can be moved in a limited manner along the adjustment axis, the locking element having no operational contact with the catches in said non-locking position, and the locking element further selectively retained on the guide rail in an assembly position in which the sliding element can be selectively removed from or introduced into the guide rail for assembly or disassembly, the guide rail providing step-like support faces defining the locking and non-locking positions and the assembly position of the locking element.

* * * * *